US010828766B2

(12) United States Patent
Kukucka et al.

(10) Patent No.: US 10,828,766 B2
(45) Date of Patent: Nov. 10, 2020

(54) TOOL HOLDING APPARATUS

(71) Applicant: GRIP HOLDINGS LLC, Brandon, FL (US)

(72) Inventors: Paul Kukucka, Brandon, FL (US); Thomas Stefan Kukucka, Brandon, FL (US)

(73) Assignee: GRIP HOLDINGS LLC, Brandon, FL (US)

( * ) Notice: Subject to any disclaimer, the term of this patent is extended or adjusted under 35 U.S.C. 154(b) by 0 days.

(21) Appl. No.: 16/738,255

(22) Filed: Jan. 9, 2020

(65) Prior Publication Data

US 2020/0147780 A1 May 14, 2020

Related U.S. Application Data

(63) Continuation-in-part of application No. 16/284,558, filed on Feb. 25, 2019, which is a continuation-in-part of application No. PCT/IB2018/060749, filed on Dec. 31, 2018, application No. 16/738,255, which is a continuation-in-part of application No. 29/710,567, filed on Oct. 24, 2019, now Pat. No. Des. 887,711, and a continuation-in-part of application No. 29/710,559, filed on Oct. 24, 2019, now Pat. No. Des. 880,977.

(60) Provisional application No. 62/643,443, filed on Mar. 15, 2018, provisional application No. 62/870,583, filed on Jul. 3, 2019.

(51) Int. Cl.
*B25H 3/00* (2006.01)

(52) U.S. Cl.
CPC ..... *B25H 3/003* (2013.01)

(58) Field of Classification Search
CPC ..... B25H 3/00; B25H 3/003; B25H 5/00
USPC ..... 206/372, 376–378
See application file for complete search history.

(56) References Cited

U.S. PATENT DOCUMENTS

| | | | | |
|---|---|---|---|---|
| 5,645,177 | A * | 7/1997 | Lin | B25H 3/04 206/378 |
| 6,431,373 | B1 * | 8/2002 | Blick | B25H 3/003 206/378 |
| 7,841,480 | B2 * | 11/2010 | Hsieh | B25H 3/06 206/378 |
| 8,336,709 | B1 * | 12/2012 | Geibel | B25H 3/06 206/350 |
| 2006/0234846 | A1 * | 10/2006 | Tucker | B25H 3/04 483/26 |

(Continued)

*Primary Examiner* — Rafael A Ortiz

(57) ABSTRACT

A tool holding apparatus includes a socket holder and at least one retaining knob. The socket holder is configured as an elongated body, wherein at least one channel that traverses into the elongated body is extended along the elongated body. The retaining knob that receives a drive socket or other similar tool apparatus includes a male body, a pedestal, and a base. The male body is adjacently connected the pedestal. The base is adjacently connected to the pedestal, opposite of the male body. The base and the pedestal are slidably engaged within the channel, and the male body is externally positioned to the elongated body thus allowing the engagement between the socket holder and the retaining knob. At least one magnet or a spring loaded ball is respectively integrated into the elongated body or the male body to securely attach a drive socket to the tool holding apparatus.

6 Claims, 13 Drawing Sheets

(56) References Cited

U.S. PATENT DOCUMENTS

2009/0120885 A1* 5/2009 Kao ..... A47F 5/0807
211/70.6

* cited by examiner

TOOL HOLDING APPARATUS

The current application is a continuation-in-part (CIP) application of a U.S. non-provisional application Ser. No. 16/284,558 filed on Feb. 25, 2019. The U.S. non-provisional application Ser. No. 16/284,558 claims a priority to the Patent Cooperation Treaty (PCT) application PCT/IB2018/060749 filed on Dec. 31, 2018. The PCT application PCT/IB2018/060749 claims a priority to a U.S. provisional application Ser. No. 62/643,443 filed on Mar. 15, 2018.

The current application also claims a priority to a U.S. provisional application Ser. No. 62/870,583 filed on Jul. 3, 2019.

The current application is a continuation-in-part (CIP) application of the U.S. design application Ser. No. 29/710,567 filed on Oct. 24, 2019 and the U.S. design application Ser. No. 29/710,559 filed on Oct. 24, 2019.

FIELD OF THE INVENTION

The present invention relates generally to a storage apparatus, particularly a storage apparatus that utilizes magnets and fastening mechanisms to retain nuts, drive sockets, or other similar articles.

BACKGROUND OF THE INVENTION

Storing of fastening components, drive sockets, or other similar articles can be difficult. The lack of simple and well-organized storage apparatus gives rise to confusion and difficulty for the user. Presently, tool storage apparatus particularly those suited for holding the drive sockets of a conventional ratchet set or similar is restricted to the one a user receives at the purchase of the particular drive socket set, or elsewise providing a disadvantageous surplus of storage space. Furthermore, the drive sockets are subject to becoming dislodged when the tool storage apparatus is positioned at an angle since the drive sockets are properly secured to the tool storage apparatus.

It is therefore an objective of the present invention to provide a tool holding apparatus to store the fastening components, drive sockets, or other similar articles. Simultaneously, the fastening components, drive sockets, or other similar articles can be securely fastened to the tool holding apparatus by utilizing a magnet or a fastening mechanism. Thus, the present invention functions as an all in one tool holding apparatus for storage of the fastening components, drive sockets, or other similar articles with a retaining means (a magnet or a fastening mechanism) that is integrated into the tool holding apparatus, without limiting the user's ability to retrieve a corresponding stored article from the tool holding apparatus.

DETAIL DESCRIPTIONS OF THE INVENTION

Figure 1:
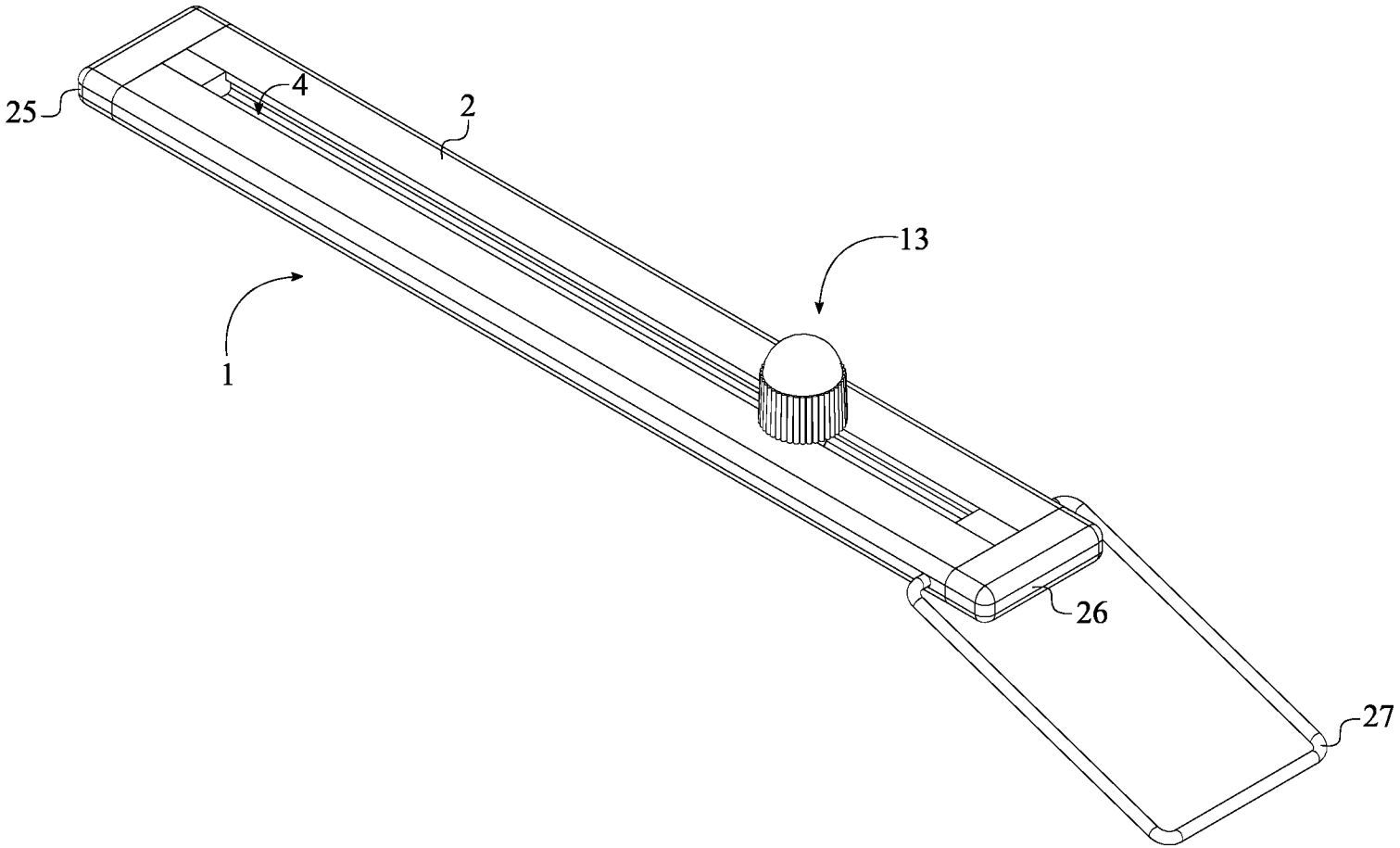
FIG. 1 is a perspective view of the present invention.

All illustrations of the drawings are for the purpose of describing selected versions of the present invention and are not intended to limit the scope of the present invention.

The present invention is a tool holding apparatus for preferably storing traditional drive socket or any other types of similar tools. The present invention is also able to securely attach with the drive socket to prevent accidental dislodging of the stored drive socket. In reference to FIG. 1-3, the present invention comprises a socket holder 1 and at least one retaining knob 13. The socket holder 1 functions as a platform to secure the retaining knob 13 and comprises an elongated body 2 and at least one channel 4. The retaining knob 13 functions as a supporting member to place the drive socket and comprises a male body 14, a pedestal 15, and a base 18.

In reference to the general configuration of the present invention, as shown in FIG. 1-3 and FIG. 13-15, the channel 4 traverses into the elongated body 2 and is extended along the elongated body 2. In other words, the channel 4 is longitudinally positioned along the elongated body 2 from one end to the other end. The channel 4 enables the retaining knob 13 to be engaged and slide along the elongated body 2 thus enabling the drive socket to be secured to the retaining knob 13. More specifically, the male body 14 is adjacently connected to the pedestal 15. The base 18 is adjacently connected to the pedestal 15 and positioned opposite of the male body 14. In reference to the engagement between the retaining knob 13 and the socket holder 1, the base 18 and the pedestal 15 are slidably engaged within the channel 4 as the male body 14 is externally positioned to the elongated body 2. An overall diameter of the male body 14 is also larger than a diameter of the pedestal 15 or the base 18. Resultantly, the male body 14 is able to provide sufficient surface area to securely attach the drive socket or to operate the retaining knob 13 within the present invention.

Figure 4:
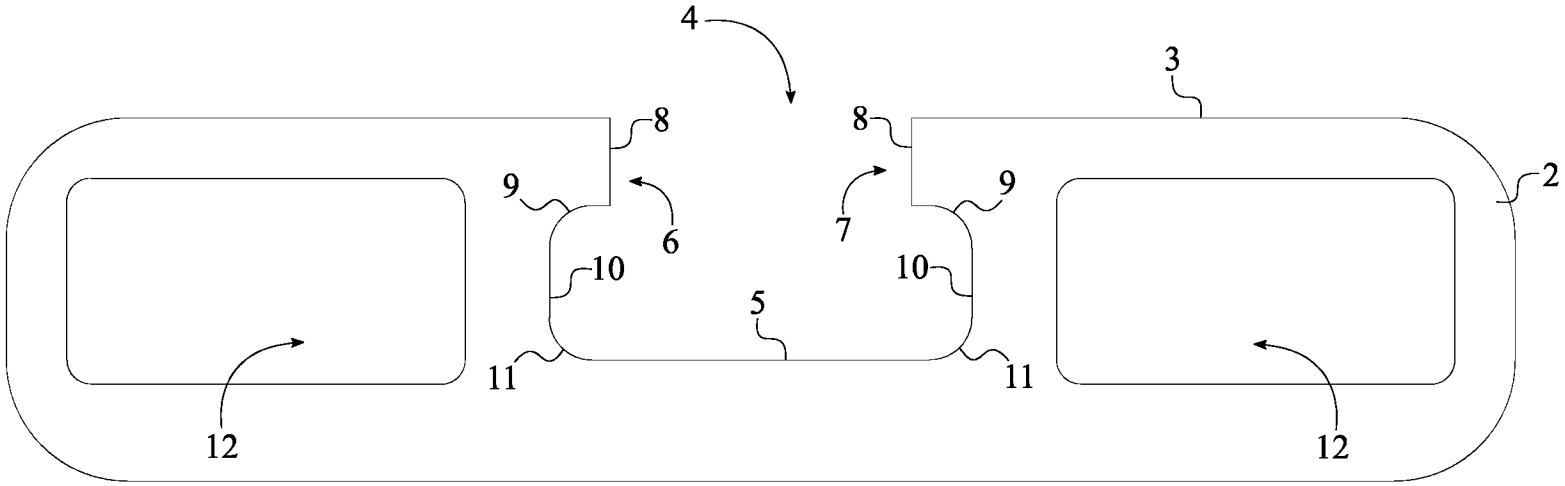
FIG. 4 is a side view of the socket holder of the present invention.

The socket holder 1 resembles a slick low-profile ergonomic design but can be of any other shape or form, wherein the elongated body 2 is generally formed into a rectangular shaped body. The socket holder 1 is made into an ergonomic shape body with radius corners to eliminate sharp corners and enhance user's comfort and safety. The channel 4 comprises a channel base 5, a first channel wall 6, and a second channel wall 7 as shown in FIG. 4. More specifically, the channel base 5 is positioned parallel to a top surface 3 of the elongated body 2 functions as the bottom surface of the channel 4 so that the base 18 of the retaining knob 13 can be slidably positioned atop the channel base 5. The first channel wall 6 and the second channel wall 7 are oppositely positioned of each other about the channel base 5 thus delineating the width of the channel 4. The first channel wall 6 and the second channel wall 7 are extended from the channel base 5 to the top surface 3 so that the height of the channel 4 can be defined within the present invention. The channel base 5 may have relief groves to further assist movement and resist binding of the retaining knob 13 when the retaining knob 13 is moved within the channel 4.

In some embodiments of the present invention, the socket holder 1 has a modular system whereby plurality of socket holders 1 can be added together by a connecting mechanism. The connecting mechanism preferably reside on the exterior lateral walls of the socket holder 1 thus creating a modular system and giving the user the flexibility of connect each of the plurality of socket holders 1 into the desired size to fit the user's needs.

The profile of the first channel wall 6 and the second channel wall 7 are essential within the present invention so that the retaining knob 13 can be fully operational. In reference to FIG. 4, the first channel wall 6 and the second channel wall 7 each comprises a top linear section 8, a top curve section 9, a bottom linear section 10, and a bottom curve section 11. More specifically, the top linear section 8 is positioned perpendicular to the top surface 3 and outlines the opening of the channel 4. The top curve section 9 is adjacently positioned to the top linear section 8 and outwardly oriented from the top linear section 8. In other words, a bottom diameter between the top curve section 9 of the first channel wall 6 and the second channel wall 7 is greater than a top diameter between the top linear section 8 of the first channel wall 6 and the second channel wall 7. The bottom linear section 10 is adjacently positioned to the top curve section 9 and positioned opposite of the top linear section 8, wherein a diameter between the bottom linear section 10 of the first channel wall 6 and the second channel wall 7 is equal to the bottom diameter between the top curve section 9 of the first channel wall 6 and the second channel wall 7. Furthermore, the top linear section 8 and the bottom linear section 10 are positioned parallel to each other. The bottom curve section 11 is adjacently positioned to the bottom linear section 10 and positioned opposite of the top curve section 9, wherein the bottom curve section 11 is inwardly oriented toward the channel base 5. In other words, a bottom diameter between the bottom curve section 11 of the first channel wall 6 and the second channel wall 7 is smaller than the diameter between the bottom linear section 10 of the first channel wall 6 and the second channel wall 7.

Due to the fact that the male body 14, a pedestal 15, and a base 18 are configured as one piece and functions coincidentally, when the retaining knob 13 is turned to a locked position or an unlocked position, all components of the retaining knob 13 move in the same direction, and or either towards or away from the channel base 5.

Figure 6:
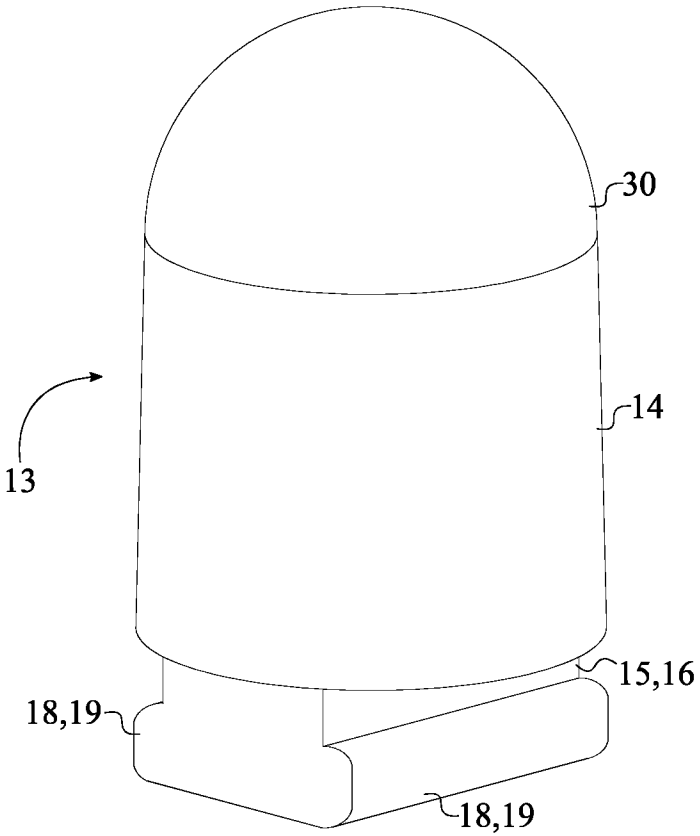
FIG. 6 is a perspective view of the retaining knob, wherein the pedestal is configured into the rectangular shaped body and the base is configured into the pair of curved tracks.
Figure 5:
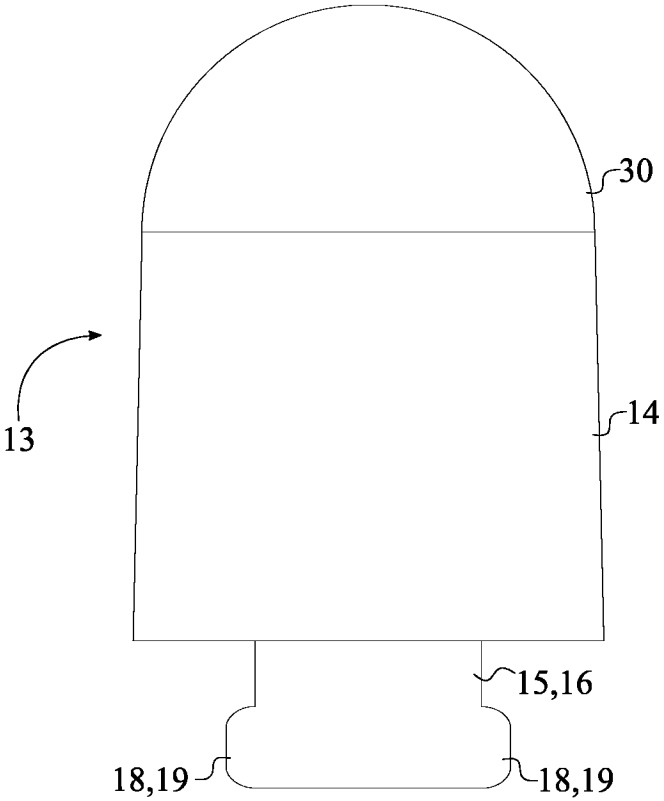
FIG. 5 is a side view of the retaining knob, wherein the pedestal is configured into the rectangular shaped body and the base is configured into the pair of curved tracks.
Figure 7:
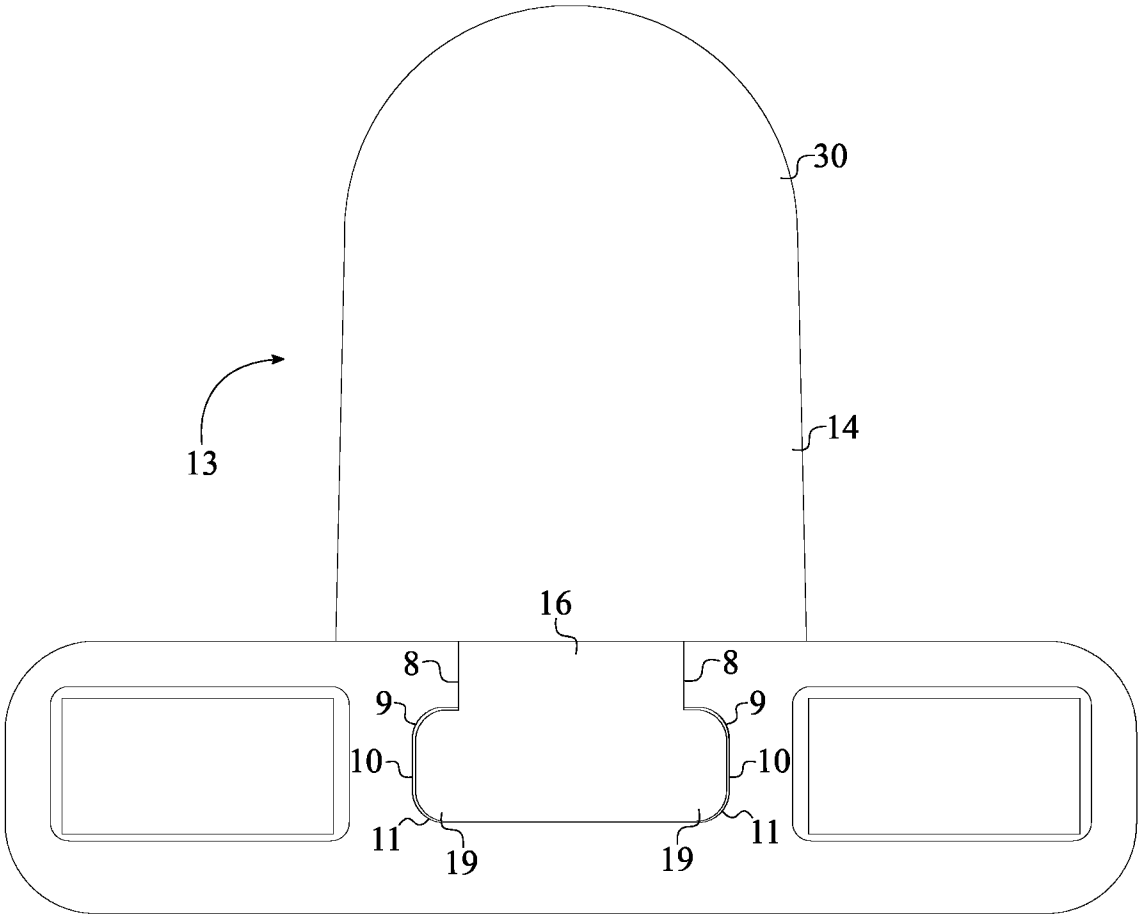
FIG. 7 is a side view present invention, showing the engagement between the socket holder and the retaining knob shown in FIG. 5-6.

In some embodiments of the retaining knob 13, the pedestal 15 is delineated into a rectangular body 16, and the base 18 is delineated into a pair of curved tracks 19 as shown in FIG. 5-7. More specifically, the pair of curved tracks 19 is laterally connected along the rectangular body 16 and oriented outward from the rectangular body 16, wherein the pair of curved tracks 19 is a pair of convex shaped structures. The rectangular body 16 is slidably engaged in between the top linear section 8 of the first channel wall 6 and the top linear section 8 of the second channel wall 7 since the base 18 slidably sits on top of the channel base 5. As a result, the pair of curved tracks 19 is engaged in between the top curve section 9, the bottom curve section 11, and the bottom linear section 10 of the first channel wall 6 and the top curve section 9, the bottom curve section 11, and the bottom linear section 10 of the second channel wall 7. Due to the engagement of the pair of curved tracks 19, the retaining knob 13 is able to slidably engage with the socket holder 1. In this embodiment, the retaining knob 13 freely slides along the channel 4 and does not allow to be locked in place upon user's preference.

Figure 9:
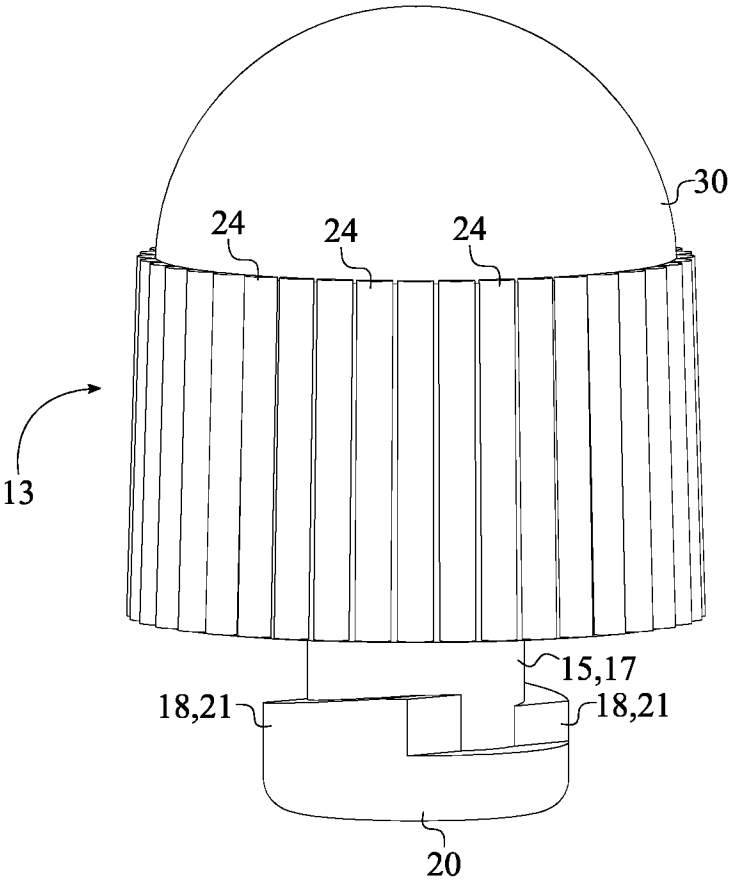
FIG. 9 is a perspective view of the retaining knob, wherein the pedestal is configured into the circular shaped body and the base is configured into the annular body and the at least one locking riser.
Figure 8:
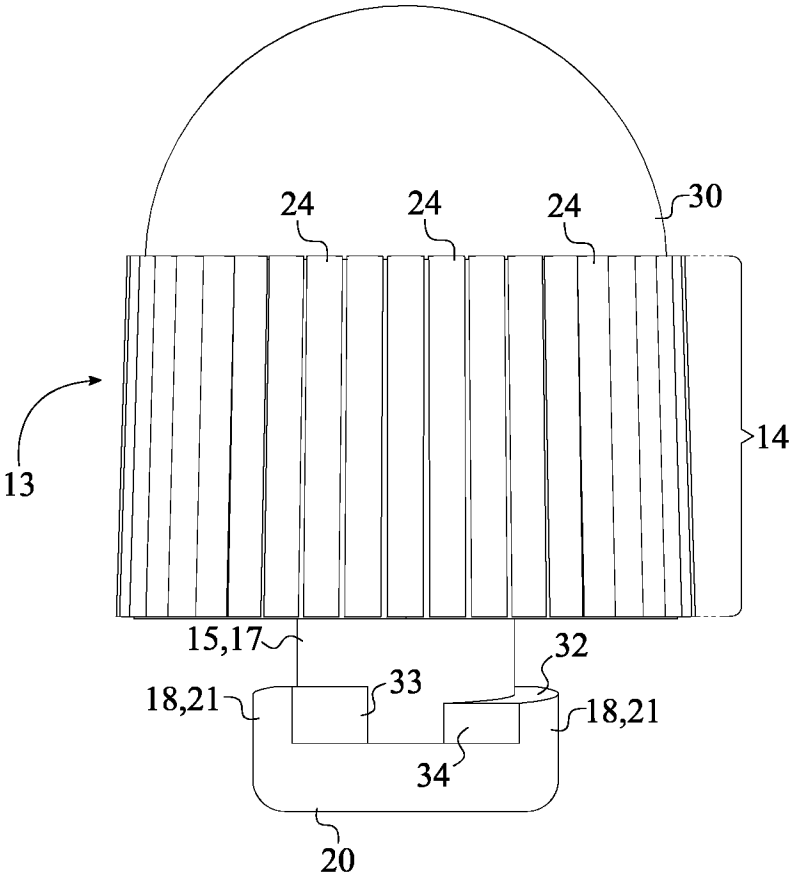
FIG. 8 is a side view of the retaining knob, wherein the pedestal is configured into the circular shaped body and the base is configured into the annular body and the at least one locking riser.
Figure 10:
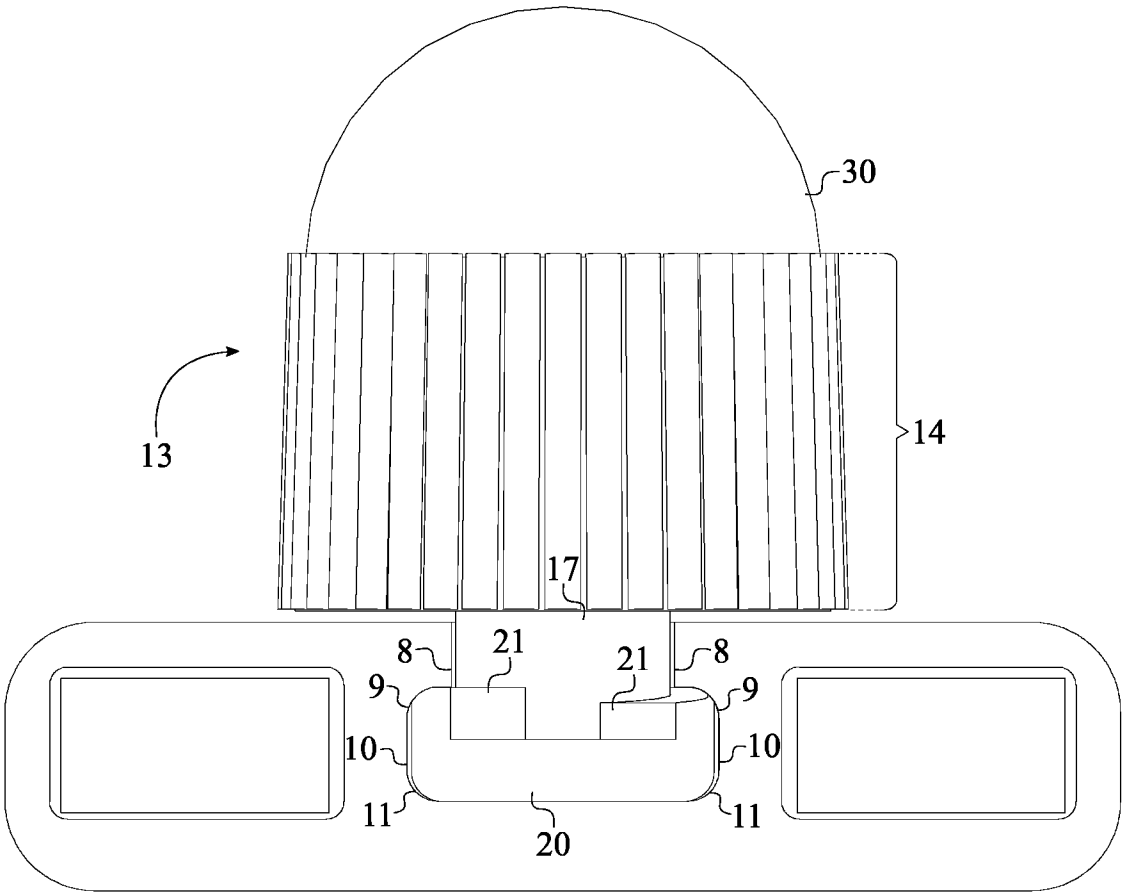
FIG. 10 is a side view present invention, showing the engagement between the socket holder and the retaining knob shown in FIG. 8-9.

In some embodiments of the retaining knob 13, the pedestal 15 is delineated into a circular body 17, and the base 18 comprises an annular body 20 and at least one locking riser 21 as shown in FIG. 8-10. More specifically, the at least one locking riser 21 is radially positioned around the annular body 20 and perimetrically connected around the annular body 20. The annular body 20 is required for the retaining knob 13 to be able to be turned from the locked position to the unlocked position or vice versa as a square, rectangular or angular shaped base cannot be rotated due to the jamming affect within the channel 4. Preferably, the at least one locking riser 21 is oriented toward the male body 14 and radially positioned around the circular body 17. However, the at least one locking riser 21 can also be oriented away from the male body 14 in such a way that the at least one locking riser 21 is radially connected around a bottom surface of the annular body 20. For example, a first riser and a second riser of the at least one locking riser 21 are positioned 180 degrees from each other. Furthermore, the at least one locking riser 21 can also be oriented radially outward from the male body 14 in such a way that the at least one locking riser 21 is laterally connected around a lateral surface of the annular body 20. The circular body 17 is rotatably engaged in between the top linear section 8 of the first channel wall 6 and the top linear section 8 of the second channel wall 7 since the base 18 slidably sits on top of the channel base 5.

In reference to the preferred positioning of the at least one locking riser 21, the at least one locking riser 21 is selectively engaged in between the top curve section 9 of the first channel wall 6 and the top curve section 9 of the second channel wall 7. Furthermore, the annular body 20 is positioned in between the bottom linear section 10 and the bottom curve section 11 of the first channel wall 6 and the bottom linear section 10 and the bottom curve section 11 of the second channel wall 7.

In reference to the first alternative positioning of the at least one locking riser 21, the at least one locking riser 21 is selectively engaged in between the bottom curve section 11 of the first channel wall 6 and the bottom curve section 11 of the second channel wall 7. Furthermore, the annular body 20 is positioned in between the bottom linear section 10 and the top curve section 9 of the first channel wall 6 and the bottom linear section 10 and the top curve section 9 of the second channel wall 7. It is further understood that the engaging function creates a clamping affect to the top curve sections 9 of the first channel wall 6 and the bottom linear section 10 with the at least one locking riser 21 and the top surface 3 of the elongated body 2 with a bottom surface of the male body 14.

In reference to the second alternative positioning of the at least one locking riser 21, the at least one locking riser 21 is selectively engaged in between the bottom linear section 10 of the first channel wall 6 and bottom linear section 10 of the second channel wall 7. Furthermore, the annular body 20 is positioned in between the bottom linear section 10 and the bottom curve section 11 of the first channel wall 6 and the bottom linear section 10 and the bottom curve section 11 of the second channel wall 7.

In reference to the third alternative positioning of the at least one locking riser 21, the at least one locking riser 21 is selectively engaged with a grove on the channel base 5. More specifically, the grove engages with the at least one locking riser 21 as the at least one locking riser 21 is located at a base of the annular body 20 and is in the unlocked position.

Due to the engagement of the annular body 20 and the at least one locking riser 21, the retaining knob 13 is able to slidably engage with the socket holder 1. In this embodiment, the retaining knob 13 freely slides along the channel 4 and does allow to be locked in place upon user's preference.

Figure 3:
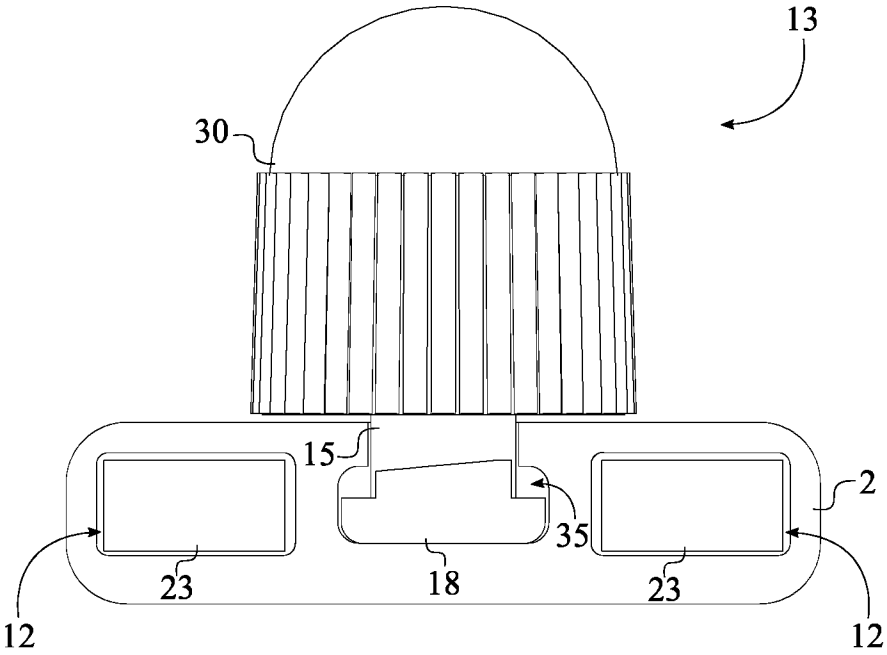
FIG. 3 is a side view of the present invention without the first and second end caps and showing the positioning of the at least one magnet.

In reference to the unlocked position as shown in FIG. 3, the annular body 20 is engaged with the bottom linear section 10 and the bottom curve section 11 of the first channel wall 6 and the bottom linear section 10 and the bottom curve section 11 of the second channel wall 7. The at least one locking riser 21 is aligned within the top linear section 8 of the first channel wall 6 and the top linear section 8 of the second channel wall 7. As a result, the at least one locking riser 21 does not engage with any parts of the channel 4 thus allowing the retaining knob 13 to slide along the channel 4 as the annular body 20 is engaged within the bottom linear section 10 and the bottom curve section 11 of the first channel wall 6 and the bottom linear section 10 and the bottom curve section 11 of the second channel wall 7.

In reference to the locked position as shown in FIG. 10, the annular body 20 is engaged with the bottom linear section 10 and the bottom curve section 11 of the first channel wall 6 and the bottom linear section 10 and the bottom curve section 11 of the second channel wall 7. The at least one locking riser 21 is angled in such a way so that when retaining knob 13 is turned into the locking function the at least one locking riser 21 pushes against the first channel wall 6 and the second channel wall 7 thus increasing friction and thereby locking the retaining knob 13 in the desired fixed position. More specifically, the at least one locking riser 21 is positioned adjacent and below the top curve section 9 of the first channel wall 6 and the top curve section 9 of the second channel wall 7. As a result, the at least one locking riser 21 is able to frictionally engage with the first channel wall 6 and the second channel wall 7 thus allowing the retaining knob 13 to locked within the channel 4. In other words, the unlocked position allows the user to grasp and slide the retaining knob 13 along the channel 4. When the retaining knob 13 need to be locked within a specific place within the channel 4, the user simply rotates the male body 14 that simultaneously initiates the engagement between the at least one locking riser 21 and the top curve section 9 of the first channel wall 6 and the top curve section 9 of the second channel wall 7.

When the retaining knob 13 is turned between approximately 1 degrees to 180 degrees clockwise from the unlocked position, the at least one locking riser 21 is engaged and locked with the top curve section 9 of the first channel wall 6 and the top curve section 9 of the second channel wall 7. When the retaining knob 13 is turned between approximately 1 degrees to 180 degrees counterclockwise from the locked position, the at least one locking riser 21 is disengaged and unlocked from the top curve section 9 of the first channel wall 6 and the top curve section 9 of the second channel wall 7. In reference to a preferred example, when the retaining knob 13 is turned between approximately 30 degrees to 90 degrees clockwise from the unlocked position, the at least one locking riser 21 is engaged and locked with the top curve section 9 of the first channel wall 6 and the top curve section 9 of the second channel wall 7. When the retaining knob 13 is turned between approximately 30 degrees to 90 degrees counterclockwise from the locked position, the at least one locking riser 21 is disengaged and unlocked from the top curve section 9 of the first channel wall 6 and the top curve section 9 of the second channel wall 7. Alternatively, the retaining knob 13 can also be rotated in reverse direction to delineate the same functionality with respect to the locked position and the unlocked position. It is understood that for the retaining knob 13 to function in reverse, the at least one locking risers 21 would need to be reversed on the base 18 so that they would function to lock the retaining knob 13 when rotated in a counter clockwise rotation and unlock the retaining knob 13 when rotated in the clockwise rotation. The preferred number of the at least one locking risers 21 is two risers.

In reference to FIG. 8, the at least one locking riser 21 comprises a tapered surface 32, a counterclockwise surface 33, and a clockwise surface 34. More specifically, the at least one locking riser 21 is designed in such a way that the clockwise surface 34 is lower than the counterclockwise surface 33 so that the tapered surface 32 can be delineated from the clockwise surface 34 to the counterclockwise surface 33. In other words, because of the tapered surface 32, the clockwise surface 34 enters into the curved section 9 of the first channel wall 6 and the second channel wall 7 when the retaining knob 13 is turned clockwise to initiate the locked position. As the retaining knob 13 is turned clockwise, the tapered surface 32 moves towards the curved section 9 of the first channel wall 6 and the second channel wall 7 and generates the locked position until the counterclockwise surface 33 reaches near the curved section 9 of the first channel wall 6 and the second channel wall 7. The tapered surface 32 can be designed according to the user's preference, further enabling retaining knob 13 to lock and unlock in a unidirectional rotation if desired. Furthermore, the locking riser taper may comprise a flat surface that is not tapered as the flat surface can be positioned in between the tapered surface 32 and the counterclockwise surface 33. All of the components would be reversed in a reverse embodiment.

The present invention further comprises a void 35 as shown in FIG. 3. More specifically, the void 35 is positioned between the counterclockwise surface 33 and the clockwise surface 34 when the at least one locking risers 21 is two risers. The void 35 is designed to assist in preventing the binding of the base 18 when in unlocked position. During the unlocked position the void 35 is positioned in the channel 4 as shown in FIG. 3 allowing for a loose engagement within the top curve section 9, the bottom linear section 10, and the bottom curve section 11 of the first channel wall 6 and the second channel wall 7 to allow for easy sliding and binding prevention.

In some embodiments of the retaining knob 13, the pedestal 15 and the base 18 can be incorporated with an external spiral threaded body that functions similar to the preferred method, wherein the at least one locking riser 21 is oriented toward the male body 14 and radially positioned around the circular body 17.

Figure 11:
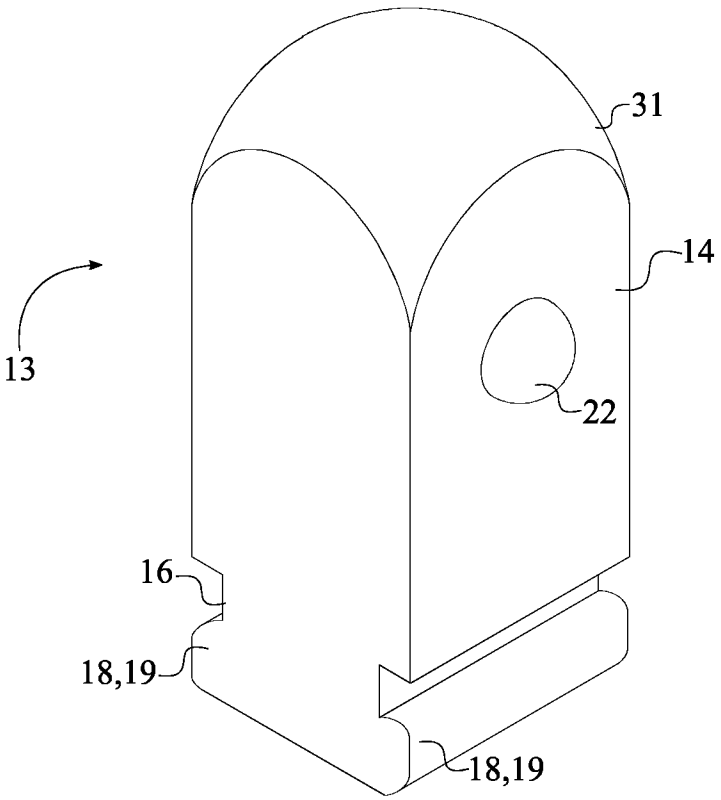
FIG. 11 is a perspective view of the retaining knob, wherein the pedestal is configured into the rectangular shaped body, the base is configured into the pair of curved tracks, the square body is the male body of the retaining knob, and the spring loaded ball is integrated into the male body.
Figure 12:
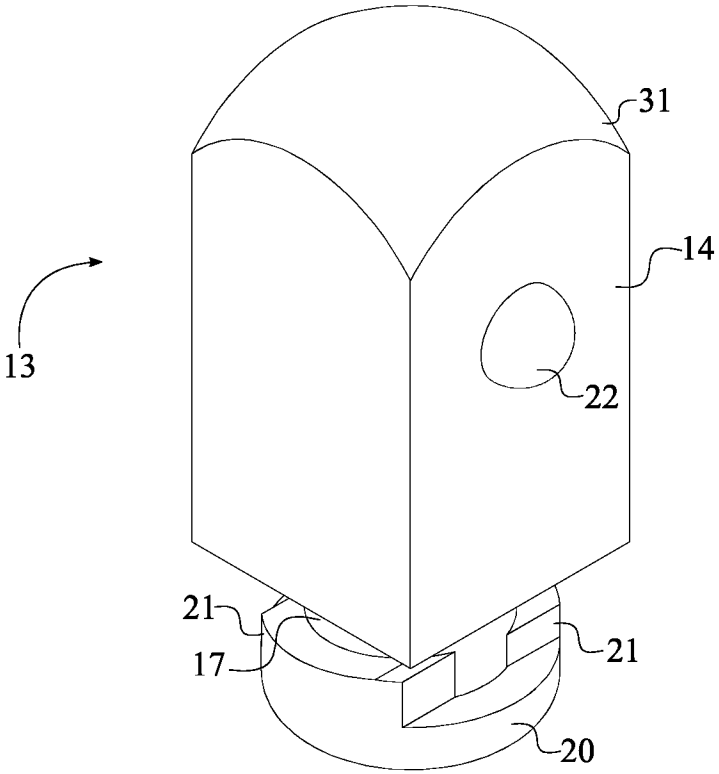
FIG. 12 is a perspective view of the retaining knob, wherein the pedestal is configured into the circular shaped body, the base is configured into the annular body and the at least one locking riser, the square body is the male body of the retaining knob, and the spring loaded ball is integrated into the male body.
Figure 13:
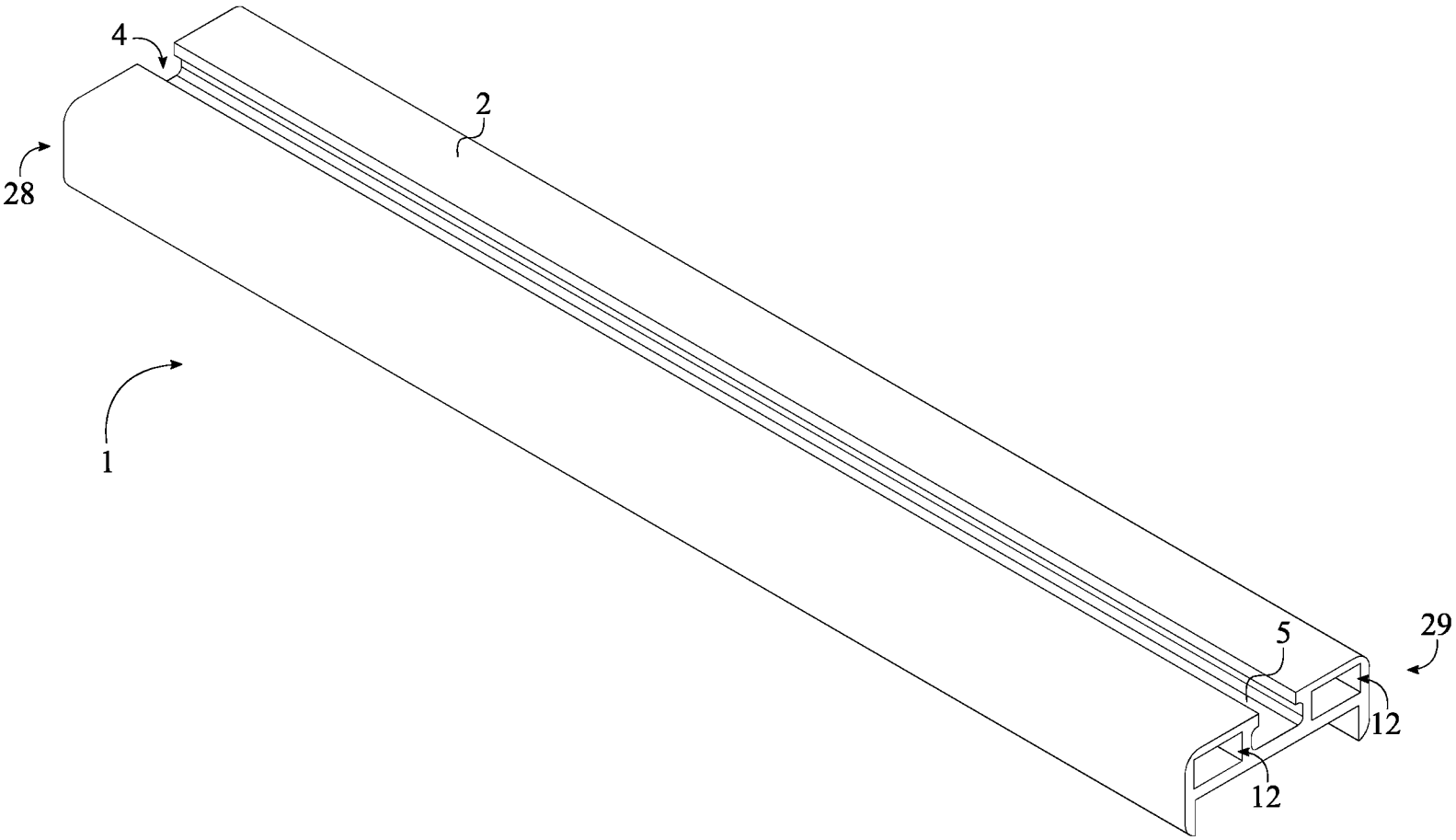
FIG. 13 is a perspective view of an alternative embodiment of the socket holder of the present invention.
Figure 14:
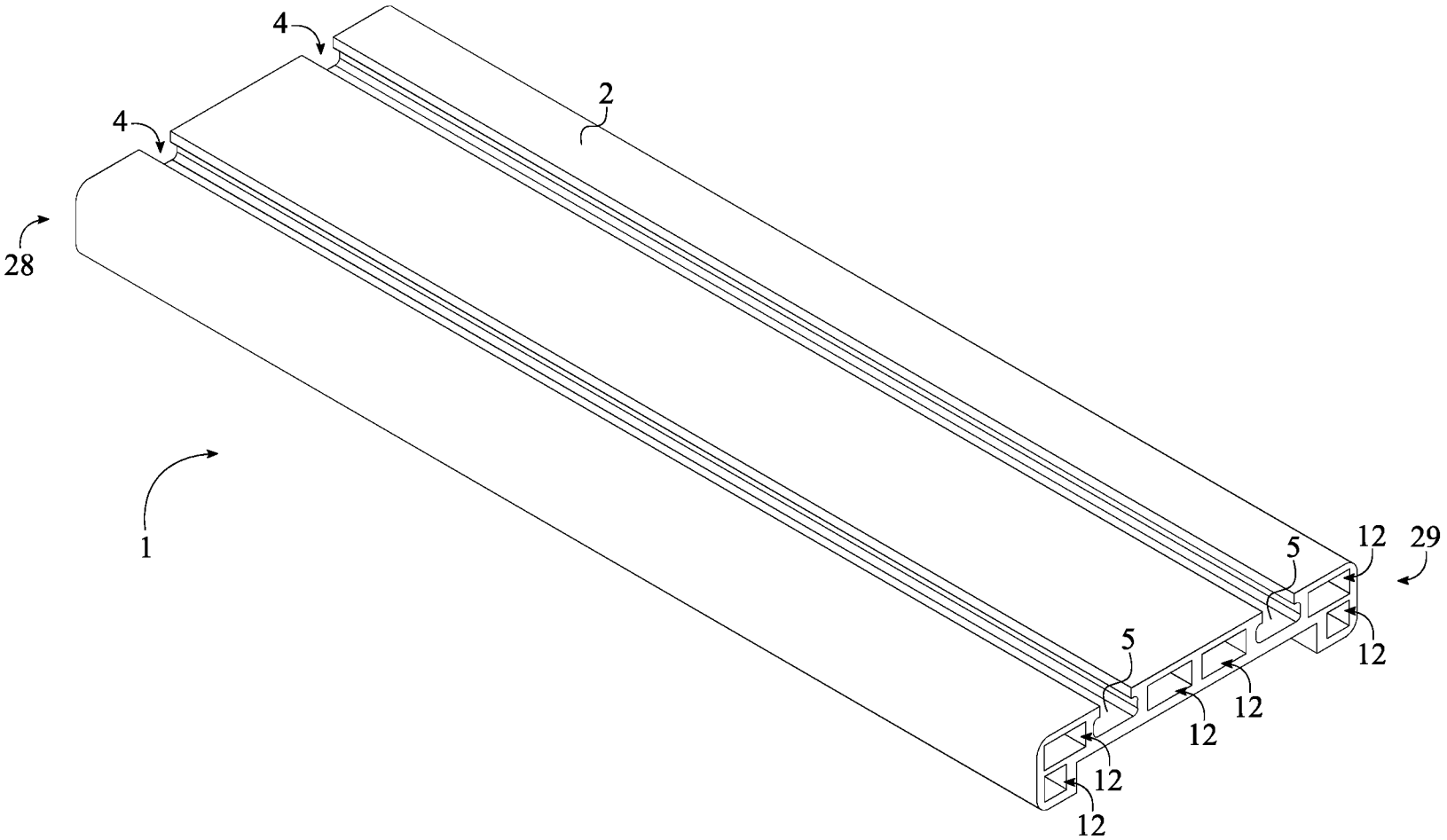
FIG. 14 is a perspective view of another alternative embodiment of the socket holder of the present invention.

In some embodiment of the present invention, the male body 14 can be formed into a cylindrical body as shown in FIG. 6 and FIG. 9. More specifically, the cylindrical body functions as the supporting body for the drive socket as the opening of the drive socket is encircled around the male body 14. Furthermore, a free end of the cylindrical body delineates a dome shape so that the opening of the drive socket can be concentrically guided and placed around the male body 14. More specifically, the present invention further comprises a dome structure 30 that is concentrically positioned to the cylindrical body. The dome structure 30 is adjacently connected to the cylindrical body and positioned opposite of the pedestal 15 as shown in FIG. 5-6. Furthermore, a plurality of ribs 24 is radially connected around the cylindrical body in order to enhance the friction between the male body 14 and the user's hand. In reference to FIG. 8-9, the plurality of ribs 24 is vertically extended along the cylindrical body and stops about the dome structure. Furthermore, each of the plurality of ribs 24 is delineate a half-cylindrical body with a curved outer surface rather than sharp edges for smoother ergonomic feel. Optionally, the plurality of ribs 24 can be replaced with a knurling pattern in order to enhance the friction between the male body 14 and the user's hand. In some embodiment of the present invention, the male body 14 can be formed into a square body as shown in FIG. 11-12. More specifically, the square body functions as the supporting body for the drive socket as the opening of the drive socket is perimetrically fitted around the male body 14. Furthermore, a free end of the square body delineates a dome shape so that the opening of the drive socket can be concentrically guided and placed around the male body 14. More specifically, the present invention further comprises a dome structure 31 that is concentrically positioned to the square body. The dome structure 31 is adjacently connected to the square body and positioned opposite of the pedestal 15 as shown in FIG. 11-12.

In some embodiment of the present invention can comprise a spring loaded ball 22 as a locking mechanism to hold the drive socket in place with the retaining knob 13. In reference to FIG. 11-12, the spring loaded ball 22 is laterally integrated into the male body 14 so that the drive socket can be removably secured to the retaining knob 13 by the spring loaded ball 22. Furthermore, the spring loaded ball 22 can be integrated into the male body 14 that can be the cylindrical body or the square body thus allowing the male body 14 to tensionally engaged with the drive socket.

Figure 15:
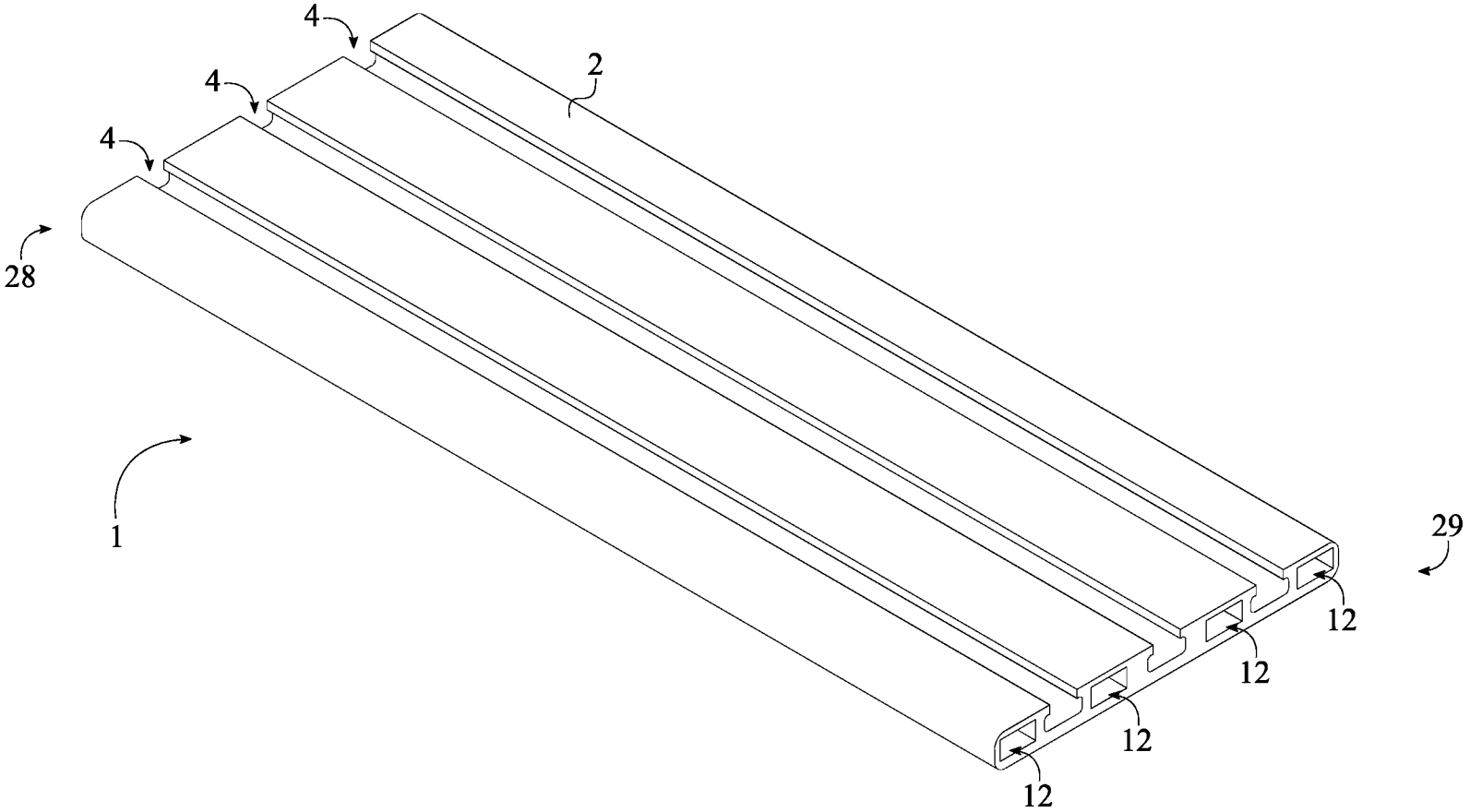
FIG. 15 is a perspective view of another alternative embodiment of the socket holder of the present invention.

In some embodiment of the present invention can comprise at least one magnet 23 and at least one opening 12 as shown in FIG. 3 and FIG. 15. The magnet 23 and the opening 12 function as a locking mechanism so that the drive socket can be removably secured to the retaining knob 13. More specifically, the opening 12 traverses through the elongated body 2 and extended along the elongated body 2. The opening 12, preferably a rectangular shape, is positioned adjacent to the channel 4 so that the functionality of the channel 4 is not hindered or limited within the present invention. Furthermore, the opening 12 comprises a plurality of curved corners for structural integrity thus eliminating right angled corners. As a result, the plurality of curved corners is able to reduce deflection when large and heavy objects are attached to the socket holder 1 that is longer in length. The magnet 23, preferably a rectangular shape or equidistant shape, is concealed within the opening 12 so that the drive socket can be removably secured to the retaining knob 13 by the magnet 23. In other words, the drive socket is able to magnetically attach to the socket holder 1 via the magnet 23 thus preventing accidental dislodging of the drive socket. Preferably, the present invention is configured with a first opening, a second opening, a first magnet 23, and a second magnet 23. Resultantly, the first opening and the second opening are oppositely positioned of each other about the channel 4 thus respectively enabling the first magnet 23 and the second magnet 23 to be positioned within corresponding opening. As a result, each ferrous article attached to the socket holder 1 is magnetized by at least one north and one south magnetic polarity. Since the magnet 23 is enclosed within the elongated body 2, the magnet 23 does not make direct contact with the drive socket or any other ferrous objects. In reference to FIG. 13-14, the exterior lateral walls of the socket holder 1 can be extended beyond a bottom surface of the elongated body 2 thus delineating a void so that the magnet 23 can be optionally mounted within.

Figure 2:
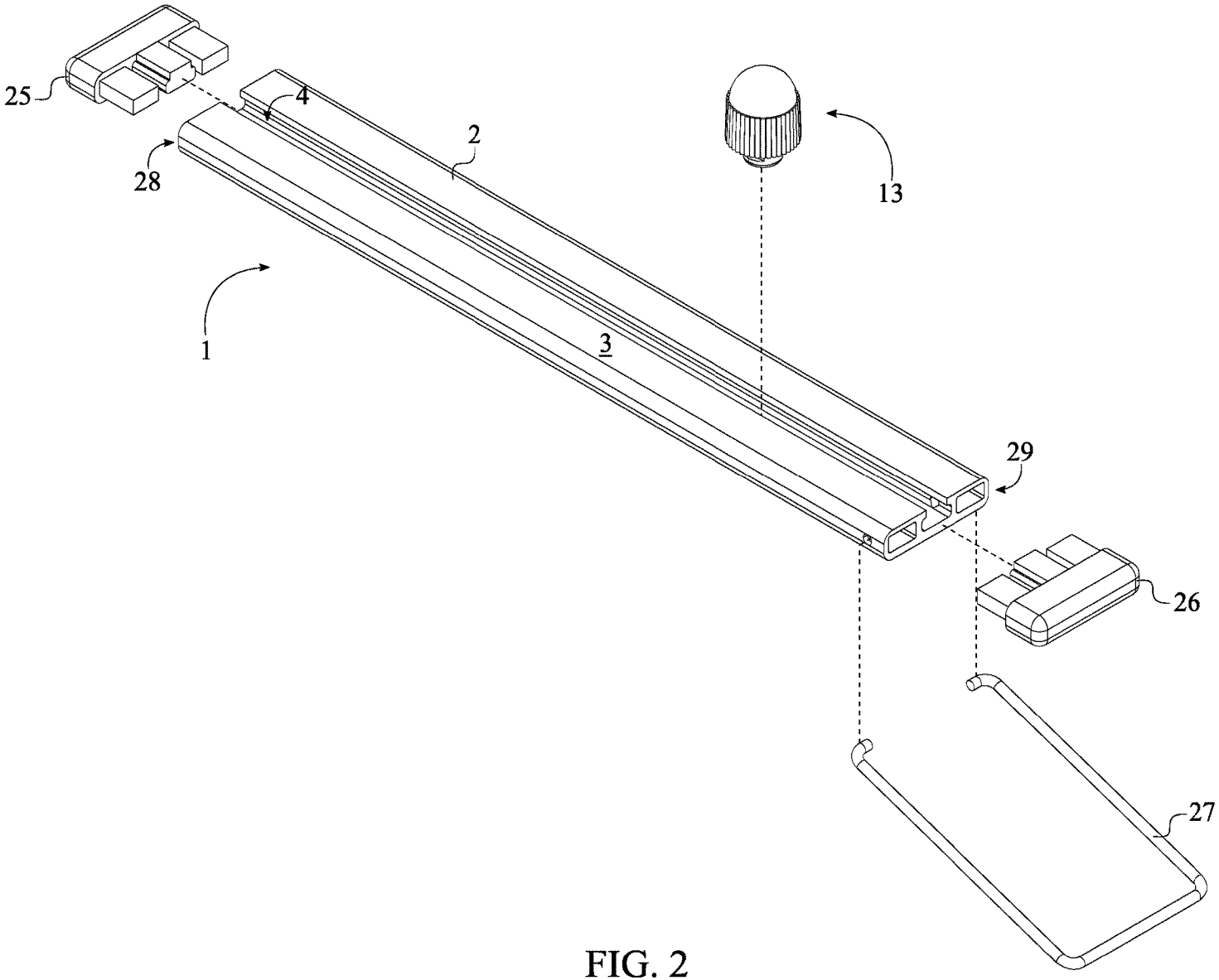
FIG. 2 is an exploded view of the present invention.

The present invention further comprises a first end cap 25 and a second end cap 26 as show in FIG. 2. The first end cap 25 is attached to a first end 28 of the elongated body 2, and the second end cap 26 is attached to a second end 29 of the elongated body 2. The first end cap 25 and the second end cap 26 function as a pair of stopper for the channel 4 so that the retaining knob 13 does not slide out of the socket holder 1 and retainers for the at least one magnet 23. More specifically, the first end cap 25 and the second end cap 26 each comprises a primary connector and a cover, wherein the primary connector is laterally connected onto the cover. The primary connector delineates a profile similar to a cross sectional profile of the channel 4 so that the primary connector can be traversed into the channel 4 and fiction fitted. As a result, the cover of the first end cap 25 can be pressed against the first end 28, and the cover of the second end cap 26 can be pressed against the second end 29. Additionally, the first end cap 25 and the second end cap 26 each can further comprise at least one secondary connector that is laterally connected to the cover. The secondary connector functions similar to the primary connector and traverses into the opening 12 thus concealing the magnet 23 within the socket holder 1. The secondary connector can be either fiction fitted to the opening 12 or magnetically attached to the magnet 23 via the opening 12. As a result, the secondary connector is able to fully enclose the magnet 23 with respect to the first end 28 and the second end 29.

The present invention further comprises a handle 27 as shown in FIG. 1-2. The handle 27 can be utilized to hang the socket holder 1. Preferably, the handle 27 is hingedly connected to the first end cap 25 or the second end cap 26 so that the socket holder 1 can be vertically hung. However, the handle 27 can also be hingedly connected to the elongated body 2 so that the socket holder 1 can be horizontally hung.

When the socket holder 1 delineates multiple channels 4 and magnets 23, the width of the socket holder 1 can be increased to accommodate corresponding channels 4 and magnets 23. Furthermore, a plurality of socket holders 1 can be mounted, attached, or connected to each other so that the storage capacity can be increased for drive sockets.

Although the invention has been explained in relation to its preferred embodiment, it is to be understood that many other possible modifications and variations can be made without departing from the spirit and scope of the invention as hereinafter claimed.

What is claimed is:

1. A tool holding apparatus comprising:

a socket holder;

at least one retaining knob;

the socket holder comprising an elongated body and at least one channel;

the retaining knob comprising a male body, a pedestal and a base;

the channel traversing into the elongated body;

the channel being extended along the elongated body;

the male body being connected the pedestal;

the base being connected to the pedestal;

the pedestal being connected in between the base and the male body;

the base and the pedestal being slidably engaged within the channel;

the male body being externally positioned to the elongated body;

the male body being formed into a cylindrical body;

a dome structure;

the dome structure being concentrically positioned to the cylindrical body;

the dome structure being connected to the cylindrical body;

the cylindrical body being connected in between the dome structure and the pedestal;

the base comprising an annular body and at least one locking riser;

the at least one locking riser being radially positioned around the annular body;

the at least one locking riser being perimetrically connected around the annular body; and the male body, the pedestal, the base and the dome structure being formed as one piece.

2. The tool holding apparatus as claimed in claim 1 comprising:

the channel comprising a channel base, a first channel wall, and a second channel wall;

the channel base being positioned parallel to a top surface of the elongated body;

the first channel wall and the second channel wall being oppositely positioned of each other about the channel base; and the first channel wall and the second channel wall being extended from the channel base to the top surface.

3. The tool holding apparatus as claimed in claim 2 comprising:

the first channel wall and the second channel wall each comprising a top linear section, a top curve section, a bottom linear section, and a bottom curve section;

the top linear section being positioned perpendicular to the top surface;

the top curve section being adjacently positioned to the top linear section;

the bottom linear section being adjacently positioned to the top curve section, opposite of the top linear section;

the bottom curve section being adjacently positioned to the bottom linear section, opposite of the top curve section; and the top linear section and the bottom linear section being positioned parallel to each other.

4. The tool holding apparatus as claimed in claim 1 comprising:

the pedestal being delineated into a circular body;

the circular body being rotatably engaged in between a top linear section of the first channel wall and a top linear section of the second channel wall;

the at least one locking riser being selectively engaged in between a top curve section and a bottom linear section of the first channel wall and a top curve section and a bottom linear section of the second channel wall; and the annular body being engaged in between the bottom linear section and a bottom curve section of the first channel wall and the bottom linear section, and a bottom curve section of the second channel wall.

5. The tool holding apparatus as claimed in claim 1 comprising:

a plurality of ribs; and the plurality of ribs being radially connected around the cylindrical body.

6. The tool holding apparatus as claimed in claim 1 comprising:

at least one magnet;

at least one opening;

the opening traversing through the elongated body;

the opening being extended along the elongated body;

the opening being positioned adjacent to the channel; and the magnet being positioned within the opening, wherein a drive socket is removably secured to the retaining knob by the magnet.

* * * * *